137-13 SR
6/11/85 XR 4,522,628

United States Patent [19]
Savins

[11] Patent Number: 4,522,628
[45] Date of Patent: Jun. 11, 1985

[54] METHOD FOR REMOVING ASH MINERAL MATTER OF COAL WITH LIQUID CARBON DIOXIDE AND WATER

[75] Inventor: Joseph G. Savins, Dallas, Tex.

[73] Assignee: Mobil Oil Corporation, New York, N.Y.

[21] Appl. No.: 515,098

[22] Filed: Jul. 19, 1983

Related U.S. Application Data

[63] Continuation-in-part of Ser. No. 331,054, Dec. 16, 1981, abandoned.

[51] Int. Cl.[3] ..... C10L 9/02
[52] U.S. Cl. ..... 44/1 SR; 137/13; 201/17
[58] Field of Search ..... 44/1 SR, 1 R, 51; 201/17; 137/13

[56] References Cited

U.S. PATENT DOCUMENTS

| | | | |
|---|---|---|---|
| 2,983,673 | 5/1961 | Grove | 201/17 X |
| 4,053,285 | 10/1977 | Robinson et al. | 44/1 SR |
| 4,198,291 | 4/1980 | Yoo et al. | 44/1 SR |
| 4,206,610 | 6/1980 | Santhanam | 423/437 X |

*Primary Examiner*—Carl F. Dees
*Attorney, Agent, or Firm*—Alexander J. McKillop; Michael G. Gilman; Charles A. Malone

[57] ABSTRACT

A method for removing the ash mineral matter content of coal and transporting the ash free coal from the point of ash removal to a coal use point comprising grinding run-of-mine coal to a desired particle size, mixing the coal particles with water and liquid carbon dioxide in a vessel in a swirling, fluidized state at a pressure, temperature, and for a residence time sufficient to free substantially all of the ash mineral matter from the coal and form an ash free coal/mineral matter slurry, separating the ash free coal particles from the slurry by froth floatation, drying the ash free coal particles, forming a slurry of the ash free coal particles with liquid carbon dioxide, transporting the ash free coal/liquid carbon dioxide slurry by pipeline to a coal use point, deslurrying the ash free coal/liquid carbon dioxide slurry, recovering the ash free coal particles for intended use and recycling the coal-free liquid carbon dioxide recovered from deslurrying for treating additional coal in the ash removal step.

10 Claims, 1 Drawing Figure

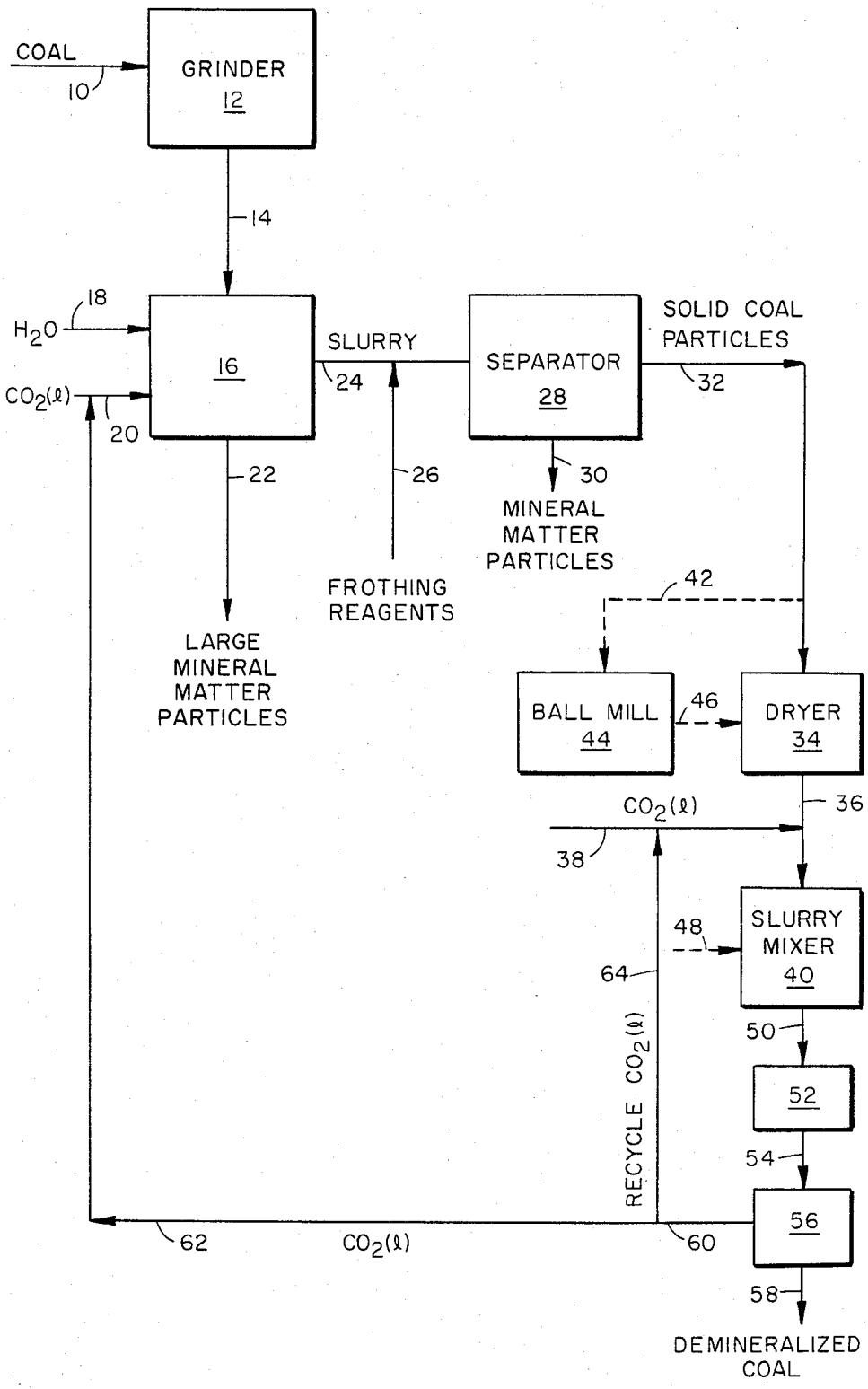
COAL
10
GRINDER
12
14
18
$H_2O$
16
$CO_2(\ell)$
20
SLURRY
24
SEPARATOR
28
SOLID COAL PARTICLES
32
22
26
30
MINERAL MATTER PARTICLES
FROTHING REAGENTS
42
LARGE MINERAL MATTER PARTICLES
BALL MILL
44
46
DRYER
34
$CO_2(\ell)$
36
38
48
SLURRY MIXER
40
64
50
RECYCLE $CO_2(\ell)$
52
54
56
62
$CO_2(\ell)$
60
58
DEMINERALIZED COAL

METHOD FOR REMOVING ASH MINERAL MATTER OF COAL WITH LIQUID CARBON DIOXIDE AND WATER

CROSS-REFERENCE TO RELATED APPLICATION

This application is a continuation-in-part of co-pending application Ser. No. 331,054, filed Dec. 16, 1981 and now abandoned.

FIELD AND BACKGROUND OF THE INVENTION

1. Field of the Invention

This invention relates generally to a method for removing the ash mineral matter content of coal and more particularly to removing ash from coal and transporting the ash free coal in a slurry form.

2. Background of the Invention

The energy crisis has made inevitable an increasing use of coal as fuel for the generation of electicity, and has also been employed as the feedstock in processes for the conversion to gaseous and liquid hydrocarbonaceous products from which fuel gas, gasoline, residual fuel oil, and the like can be obtained. However, coal contains undesirable amounts of mineral matter (non-carbonaceous matter) and its removal improves the quality of the coal and makes it easier for specifications to be met, and renders the conditions of subsequent use of the coal more flexible.

Coal is generally classified in four groups: (1) anthracite, (2) bituminous, (3) sub-bituminous, and (4) lignite. The ash mineral matter content of these coals may vary from about 1 percent to as high as 50 percent by weight.

U.S. Pat. No. 3,998,604 to Hinkley, discloses a method for the demineralization of a low rank coal comprising the steps of forming the coal into a slurry, grinding the slurry in the presence of an aqueous acid such as HCl, $H_2SO_4$, and $H_2CO_3$ and the slurry is subjected to froth flotation in the presence of a gas selected from $Cl_2$, $SO_2$, or $CO_2$.

It is known to transport coal by pumping it as a water or liquid carbon dioxide slurry through pipelines from a coal source point to a coal use point. U.S. Pat. No. 4,206,610 to Santhanam, discloses a method for transporting coal in finely divided form in a liquid carbon dioxide slurry wherein the liquid carbon dioxide used as the slurry liquid is formed by burning coal at the coal source point and liquifying the resulting gaseous carbon dioxide.

This is an improved method for removing the ash mineral content of coal utilizing liquid carbon dioxide combined with transporting ash free coal by pumping it as an ash free coal/liquid carbon dioxide slurry from the point of ash removal to a coal use point, recovering the liquid carbon dioxide slurry liquid at the coal use point and returning it for use in the ash removal step.

SUMMARY OF INVENTION

This invention relates to a method for removing ash mineral matter content of coal, slurrying the ash free coal for transporting it through a pipeline from the point of ash removal to a coal use point, deslurrying the coal at the use point and recycling the liquid carbon dioxide recovered from deslurrying to the ash removal step. In the first step of the method, run-of-mine coal is crushed to a desired top size and the coal is mixed with liquid carbon dioxide and water in a vessel in a swirling, fluidized state at a selected pressure, and temperature and for a residence time sufficient to free substantially all of the ash mineral matter from the coal and forming a coal/mineral matter slurry. The coal/mineral matter slurry is passed to a froth flotation treatment in which the ash free coal particles are separated from the slurry. The coal particles are dried and then slurried with liquid carbon dioxide to form an ash free coal/liquid carbon dioxide slurry. The slurry is then transported by a pipeline to a coal use point. Depending on the rheological characteristics of the ash free coal/carbon dioxide slurry entering the pipeline, a certain weight fraction of dry ash free coal, having a particular size distribution or top size, i.e., "fines", may be substituted to provide the viscous stabilization required to inusre that the coarser size fraction of ash free coal is supported, especially if the line is a long distance pipeline system. Alternatively, suspending ability of the ash free coal may be improved by the addition of a viscosifier which will thicken the liquid phase. At the coal use point, the ash free coal/liquid carbon dioxide slurry is deslurried and the separated ash free coal withdrawn for the intended use, and the essentially coal-free liquid carbon dioxide returned for treating additional coal in the ash removal step.

BRIEF DESCRIPTION OF THE DRAWING

The FIGURE is an overall schematic diagram showing the system for carrying out the preferred arrangement of the ash removal steps and transporting the ash free coal in slurry form according to the present invention.

DESCRIPTION OF THE PREFERRED EMBODIMENTS

The invention may be better understood by referring to the accompanying drawing which represents diagrammatically a flow scheme for the practice of the present invention. Run-of-mine size coal, which can be one or a mixture of two or more of anthracite, bituminous, lignite, peat, and the like, is introduced through line 10 to crusher mechanism 12 where it reduced to some convenient size, preferably to a topsize which is essentially 100 percent minus 1 inch. The crushed coal is then transferred through line 14 into a pressurized vessel 16 where it is mixed with water from line 18 and liquid carbon dioxide from line 20. The crushed coal, water, and liquid carbon dioxide are intimately mixed in vessel 16 so as to maintain the mixture in a swirling, fluidized state at a selected pressure, temperature, and for a residence time sufficient to physically weaken the coal particles and free substantially all of the the ash mineral matter from the coal. The pressure and temperature within the vessel are adjusted so as to produce a single phase of $CO_2$ and water. Pressure is generally in the range of 900 to 3000 psia. The preferred pressure is about 1000 psia, and the corresponding temperature required to produce a single phase at this pressure is about 104° F. Pressure and temperature conditions and mole fractions of $CO_2$ and water needed to produce the required solubility parameter needed to comminute the coal and release the mineral matter must be determined by trial-and-error because of the complex heterogeneous nature of coal. Separation of the ash mineral matter from the coal particles is assisted by application of agitation and shear, either by gas entrainment, mechanical means, or other suitable means. The residence time will depend on the amount and composition of ash mineral matter in the coal and the rank of the coal. In the operation of treating the coal in vessel 16, the mol fractions of water and liquid carbon dioxide are determined by the rank and composition of the coal. Generally, as rank decreases, the mol fraction of liquid carbon dioxide required decreases.

Large particles of ash mineral matter separated from the coal will settle by gravity to the bottom of the vessel 16 and can be removed from the bottom thereof through line 22. To free the remainder of the ash mineral matter suspended with the coal, the coal/mineral matter slurry is removed from vessel 16 through line 24 and with a suitable flotation reagent from line 26 is introduced into froth flotation separator 28 where the ash free coal particles are separated from the ash mineral matter and withdrawn as the "floats" or "sinks" (depending on the flotation reagents selected). Ash mineral matter separated by separator 28 is removed from the separator through line 30. Coal particles substantially free of ash are withdrawn from separator 28 through line 32 and the entire stream may be introduced into drier 34 where the low ash coal particles are dried. The dried low ash coal particles are withdrawn by suitable means from drier 34 through line 36 and with liquid carbon dioxide from line 38 are introduced into mixing chamber 40 to form a coal/carbon dioxide slurry. However, the rheology needed to produce a slurry that will support the largest coal particles depends to a large measure on the percentage of "fines" present, as this size fraction imparts viscous suspending ability. An alternative is to add a non-coal material which will thicken the carrier phase. A third, but less attractive, alternative to the addition of fines or a non-coal thickening agent is to raise the pumping velocity and depend on turbulence to support the coarse particles in the pipeline. Therefore, if it is necessary to improve the suspending ability of the final ash free coal/-$CO_2$ slurry entering the pipeline, and the use of a non-coal thickener is not contemplated, a small fraction of the stream which is to enter drier 34 is diverted via line 42 to ball mill 44, or any suitable size reduction device, where "fines" are produced having a particle size that will pass a 325 mesh screen. The resultant fines are then withdrawn from ball mill 44 and introduced into drier 34 via line 46. If suspending ability is to be improved by the addition of a non-coal viscosifier, this material is introduced into slurry mixer 40 via line 48. The ash free coal/carbon dioxide slurry is then transferred through a slurry pipeline 50 to a coal use point 52 under conditions of temperature and pressure to maintain the carbon dioxide in liquified form. At the coal use point, the ash free coal/carbon dioxide slurry is withdrawn through line 54 and introduced into a deslurrying means 56 to separate the coal from the liquid carbon dioxide. The ash free coal particles are withdrawn from deslurrying means 56 through line 58 and transported to the point of end use. The coal-free liquid carbon dioxide is withdrawn from deslurrying means 56 through line 60 and returned to vessel 16 through lines 60, 62 and 20 for use in reducing the ash content of the coal therein.

In another embodiment of the invention, preferably when the amount of ash mineral matter in the raw coal is low and the amount of liquid carbon dioxide required to treat the coal for ash removal is reduced, a portion of liquid carbon dioxide from deslurrying means 56 is recycled to be used to form a slurry with the dried ash free coal through lines 60, 64, and 38.

The method for preparing the ash free coal/liquid carbon dioxide slurry, pumping said slurry through a pipeline to the coal use point as well as deslurrying the ash free coal/liquid carbon dioxide slurry may be conducted in accordance with the method discussed in U.S. Pat. No. 4,206,610, to C. J. Santhanam, the disclosure of which is hereby incorporated by reference.

Obviously, many other variations and modification of the invention as hereinbefore set forth may be made without departing from the spirit and scope thereof and therefore only such limitations should be imposed as are indicated in the appended claims.

What is claimed is:

1. A method for removing the ash mineral matter content of run-of-mine coal comprising:

(a) grinding the run-of-mine coal to a particle size to form a suitable slurry;

(b) mixing the coal particles with water and liquid carbon dioxide in a vessel;

(c) determining the solubility parameter of said coal and maintaining the mixture of coal particles, liquid carbon dioxide, and water in the mixing vessel in a swirling, fluidized state at a pressure, temperature, and for a residence time sufficient to separate ash mineral matter from the coal particles and form an ash free coal/mineral matter slurry; and (d) separating the ash free coal particles from the ash free coal/mineral matter slurry by froth floatation and recovering the coal particles substantially free of ash mineral matter.

2. The method of claim 1 wherein the pressure during step (c) is within the range of 900 to 3000 psia and the temperature is sufficient to produce a single phase of carbon dioxide and water.

3. The method of claim 1 wherein the pressure during step (c) is about 1000 psia and the temperature is about 104° F.

4. The method of claim 1 further comprising withdrawing large ash forming mineral matter particles from the bottom of said mixing vessel.

5. A method for removing the ash mineral matter content of run-of-mine coal and transporting the low ash content coal from the ash demineralizing point to a coal use point comprising:

(a) grinding the run-of-mine coal to a particle size to form a suitable slurry;

(b) mixing the coal particles with water and liquid carbon dioxide in a vessel;

(c) determining the solubility parameter of said coal and maintaining the mixture of coal particles, liquid carbon dioxide, and water in the mixing vessel in a swirling, fluidized state at a pressure, temperature, and for a residence time sufficient to separate ash mineral matter from the coal particles and form an ash free coal/mineral matter slurry;

(d) separating the low ash coal particles from the coal/mineral slurry by froth floatation and recovering the coal particles substantially free of ash mineral matter;

(e) drying said recovered ash free coal particles;

(f) slurrying said dried ash free coal particles with liquid carbon dioxide to form an ash free coal/carbon dioxide slurry;

(g) pumping said slurry through a pipeline to said coal use point;

(h) deslurrying said ash free coal/carbon dioxide slurry at said coal use point to separate said ash free coal and said liquid carbon dioxide; and (i) recovering said coal-free liquid carbon dioxide and passing said liquid carbon dioxide through a pipeline for admixture with said coal being treated in step (b).

6. The method of claim 5 wherein the pressure during step (c) is within the range of 900 to 3000 psia and the temperature is sufficient to produce a single phase of carbon dioxide and water.

7. The method of claim 5 wherein the pressure during step (c) is about 1000 psia and the temperature is about 104° F.

8. The method of claim 4 further comprising recycling at least a portion of said coal-free liquid carbon dioxide recovered during step (h) back to said ash removal point for reuse in forming said slurry during step (f).

9. The method of claim 5 further comprising withdrawing a portion of the separated coal particles substantially free of ash mineral matter prior to drying, reducing the particle size of said ash free coal particles to a particle size that will pass a 325 mesh screen, and then mixing the resulting finely divided ash free coal particles with the ash free coal particles being dried during step (e).

10. The method of claim 5 further comprising adding a viscosity-increasing additive to the ash free coal/carbon dioxide slurry formed during step (f) to improve the suspending ability of the ash free coal/carbon dioxide slurry.

* * * * *